US010011337B2

(12) United States Patent
MacCready et al.

(10) Patent No.: US 10,011,337 B2
(45) Date of Patent: Jul. 3, 2018

(54) WATER DRONE

(71) Applicant: APIUM INC., Glendale, CA (US)

(72) Inventors: Tyler MacCready, Pasadena, CA (US); Anthony White, Los Angeles, CA (US); Drew Franklin Heltsley, Alhambra, CA (US)

(73) Assignee: Apium Inc., Glendale, CA (US)

( * ) Notice: Subject to any disclaimer, the term of this patent is extended or adjusted under 35 U.S.C. 154(b) by 0 days.

(21) Appl. No.: 15/226,915

(22) Filed: Aug. 2, 2016

(65) Prior Publication Data

US 2017/0036746 A1 Feb. 9, 2017

Related U.S. Application Data

(60) Provisional application No. 62/200,559, filed on Aug. 3, 2015.

(51) Int. Cl.

| | |
|---|---|
| ***B63G 8/16*** | (2006.01) |
| ***B63G 8/08*** | (2006.01) |
| *B63H 5/08* | (2006.01) |
| *B63B 35/00* | (2006.01) |
| *B63G 8/00* | (2006.01) |

(52) U.S. Cl.

CPC ..... *B63G 8/08* (2013.01); *B63G 8/16* (2013.01); *B63B 2035/008* (2013.01); *B63G 2008/005* (2013.01); *B63H 5/08* (2013.01)

(58) Field of Classification Search

CPC ... B63G 8/14; B63G 8/16; B63G 8/18; B63G 8/20; B63G 8/22; B63G 8/24; B63G 8/26

See application file for complete search history.

(56) References Cited

U.S. PATENT DOCUMENTS

| | | | |
|---|---|---|---|
| 4,519,335 | A | 5/1985 | Krautkremer et al. |
| 5,237,952 | A | 8/1993 | Rowe |
| 7,127,333 | B2 | 10/2006 | Arvidsson |
| 8,131,412 | B2 | 3/2012 | Larsson et al. |

(Continued)

FOREIGN PATENT DOCUMENTS

FR 2 677 324 A1 12/1992

OTHER PUBLICATIONS

International Search Report and Written Opinion dated Oct. 21, 2016 for PCT Application No. US16/45213 (11 pages).

(Continued)

*Primary Examiner* — Andrew Polay

(74) *Attorney, Agent, or Firm* — Lewis Roca Rothgerber Christie LLP

(57) ABSTRACT

A water drone capable of navigating on the surface, or below the surface, of a body of water. In some embodiments such a vehicle is light-weight, electric-powered, and propeller-driven, and may be operated by remote control from the shore and guided with simple autopilot commands. The vehicle may have two actuators at the rear of the vehicle, each including a motor and a propeller, and each capable of producing forward or reverse thrust. The vehicle may be capable of travelling horizontally through the surf zone and diving vertically through the water column to the seafloor. The vehicle may monitor its own location and depth and may measure environmental conditions such as water temperature; such measurements may be communicated back to the operator using a telemetry system.

27 Claims, 18 Drawing Sheets

(56) References Cited

U.S. PATENT DOCUMENTS

| | | | | |
|---|---|---|---|---|
| 8,418,642 | B2 | 4/2013 | Vosburgh | |
| 8,965,606 | B2 | 2/2015 | Mizutani | |
| 9,051,036 | B2 | 6/2015 | Kim et al. | |
| 9,487,281 | B2 * | 11/2016 | Wolfenbarger | B63G 8/001 |
| 2007/0203623 | A1 | 8/2007 | Saunders et al. | |
| 2010/0138083 | A1 | 6/2010 | Kaji | |
| 2012/0137949 | A1 | 6/2012 | Vosburgh | |
| 2016/0229503 | A1 * | 8/2016 | Sheard | B63G 8/001 |

OTHER PUBLICATIONS

International Preliminary Report on Patentability dated Aug. 16, 2017 for corresponding PCT Application No. PCT/US16/45213 (8 pages).

* cited by examiner

WATER DRONE

CROSS-REFERENCE TO RELATED APPLICATION(S)

The present application claims priority to and the benefit of U.S. Provisional Application No. 62/200,559, filed Aug. 3, 2015, entitled "WATER DRONE", the entire content of which is incorporated herein by reference.

FIELD

One or more aspects of embodiments according to the present invention relate to a vehicle, and more particularly to a vehicle capable of operating on the surface or below the surface of a body of water.

BACKGROUND

With society's increasing impact on and reliance on the ocean there is an increasing need for information from areas that are difficult to access. Large unmanned vehicles (drones) may be employed for aquatic access, but their size and expense often preclude their use in challenging areas such as the near-shore region where crashing surf and shallow waters threaten vehicle safety.

Thus, there is a need for a beach-deployable, surf-survivable water drone that can access the ocean within the first few hundred meters of the shoreline.

SUMMARY

Aspects of embodiments of the present disclosure are directed toward a convenient, remotely operated vehicle, or "water drone", suitable for easy, reliable use in the near-shore environment. In some embodiments such a vehicle is light-weight, electric-powered, and propeller-driven, and may be operated by remote control from the shore and guided with simple autopilot commands. It may be capable of travelling horizontally through the surf zone and diving vertically through the water column to the seafloor. The vehicle may monitor its own location and depth and may measure environmental conditions such as water temperature; such measurements may be communicated back to the operator using a telemetry system.

According to an embodiment of the present invention there is provided a vehicle for use in a body of water having a surface, the vehicle including: a hull having a front end and a rear end and defining a longitudinal axis; a communications system including an antenna positioned at the front end of the hull; and a propulsion system including two actuators, each actuator including a propeller positioned at the rear end of the hull and configured to supply thrust along a thrust vector, the vehicle being configured to: assume a first steady-state position when the propulsion system produces no thrust, an elevation angle of the longitudinal axis in the first steady-state position being greater than 20 degrees; assume a second steady-state position when the propulsion system produces forward thrust of a first magnitude, the elevation angle of the longitudinal axis in the second steady-state position being greater than 0 degrees and less than 40 degrees; and assume a third steady-state position when the propulsion system produces reverse thrust of a second magnitude, the elevation angle of the longitudinal axis in the second steady-state position being greater than 60 degrees.

In one embodiment, the elevation angle of the longitudinal axis in the first steady-state position is greater than the elevation angle of the longitudinal axis in the second steady-state position.

In one embodiment, the elevation angle of the longitudinal axis in the first steady-state position is greater than the elevation angle of the longitudinal axis in the second steady-state position by at least 10 degrees.

In one embodiment, the elevation angle of the longitudinal axis in the third steady-state position is greater than the elevation angle of the longitudinal axis in the first steady-state position.

In one embodiment, the elevation angle of the longitudinal axis in the third steady-state position is greater than the elevation angle of the longitudinal axis in the first steady-state position by at least 10 degrees.

In one embodiment, in the first steady-state position and in the second steady-state position the front end of the hull is entirely above the surface of the body of water.

In one embodiment, the two actuators are configured to be independently controllable.

In one embodiment, the propulsion system of the vehicle is capable of producing sufficient reverse thrust to overcome a buoyancy of the vehicle and displace the vehicle entirely below the surface of the body of water.

In one embodiment, the propulsion system of the vehicle is capable of producing sufficient forward thrust to propel the vehicle entirely into the air from an initial position entirely below the surface of the body of water.

In one embodiment, the vehicle is capable of steady-state rotation in roll at a substantially constant rate of roll when: the vehicle is entirely below the surface of the body of water; and a first actuator of the two actuators produces reverse thrust of a first magnitude and a second actuator of the two actuators produces reverse thrust of a second magnitude, the first magnitude being greater than the second magnitude.

In one embodiment, the rate of roll is greater than 20 degrees per second.

In one embodiment, the vehicle is capable of steady-state rotation in yaw at a substantially constant rate of yaw when a first actuator of the two actuators produces a first thrust and a second actuator of the two actuators produces a second thrust, the first thrust being different from the second thrust.

In one embodiment, the first thrust is a forward thrust and the second thrust is a reverse thrust.

In one embodiment, the first thrust is a forward thrust of a first magnitude and the second thrust is a forward thrust of a second magnitude, the first magnitude being greater than the second magnitude.

In one embodiment, the rate of yaw is greater than 5 degrees per second.

In one embodiment, the antenna is external or internal to the hull, and wherein the vehicle further includes a global positioning system receiver.

In one embodiment, a center of mass of the vehicle is identically located while the vehicle is in each of the first steady-state position, the second steady-state position, and the third steady-state position; and a center of volume of the vehicle is identically located while the vehicle is in each of the first steady-state position, the second steady-state position, and the third steady-state position.

In one embodiment, a center of volume of the vehicle is closer to the rear end of the hull than to the front end.

BRIEF DESCRIPTION OF THE DRAWINGS

These and other features and advantages of the present invention will be appreciated and understood with reference to the specification, claims, and appended drawings wherein:

DETAILED DESCRIPTION

The detailed description set forth below in connection with the appended drawings is intended as a description of exemplary embodiments of a water drone provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Figure 1:
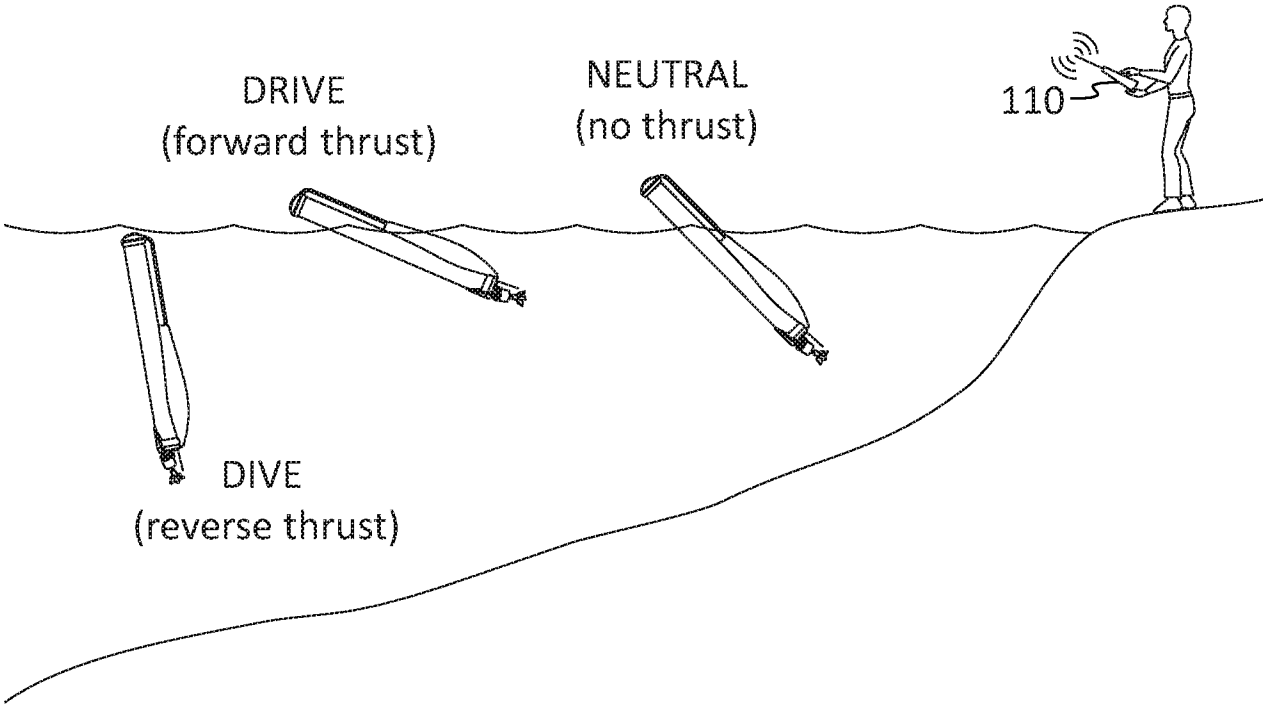
FIG. 1 is a schematic diagram of an operator and a vehicle in three different positions, according to an embodiment of the present invention.

FIG. 1 illustrates three different stable (e.g., steady-state) positions of a vehicle, in one embodiment. An operator on shore uses a telemetry and command system such as a radio control system, or "operator console" 110 to drive the vehicle through the surf zone and to command automated dive profiles. By varying the magnitude and direction of thrust (e.g., thrust produced by propellers at the rear of the vehicle), the vehicle may achieve three different stable steady-state positions. When no thrust is produced, the vehicle may assume a first position referred to herein as the neutral position, in which the vehicle sits at an inclined angle, keeping the command and telemetry radio antenna above the water surface. When forward thrust is produced, the vehicle may pitch down (i.e., pitch forward) into a second position referred to herein as the drive position, in which the orientation of the vehicle is suited for forward travel along the water surface. When reverse thrust is produced, e.g., starting from the neutral position, the vehicle may pitch up (i.e., pitch backward) into a third position referred to herein as the dive position, in which the longitudinal axis of the vehicle is substantially vertical. In the dive position the vehicle may dive, tail first vertically downward, through the water column to considerable depth. The telemetry and command may be temporarily unavailable when the vehicle is submerged, and accordingly the vehicle may follow preprogrammed commands in this mode, e.g., diving to a preprogrammed depth and then returning to the surface.

Figure 2A:
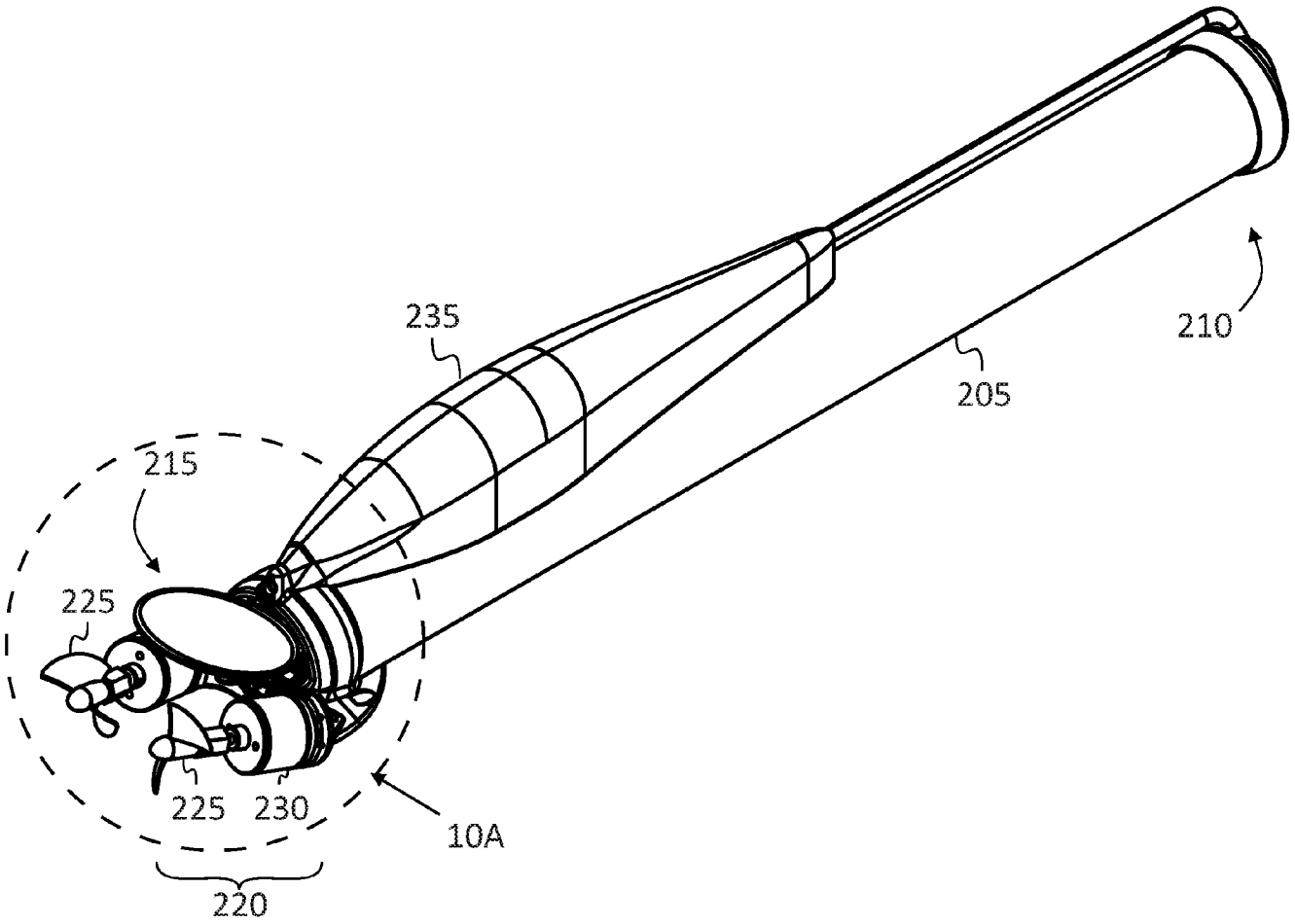
FIG. 2A is a perspective view of a vehicle, according to an embodiment of the present invention.
Figure 2B:
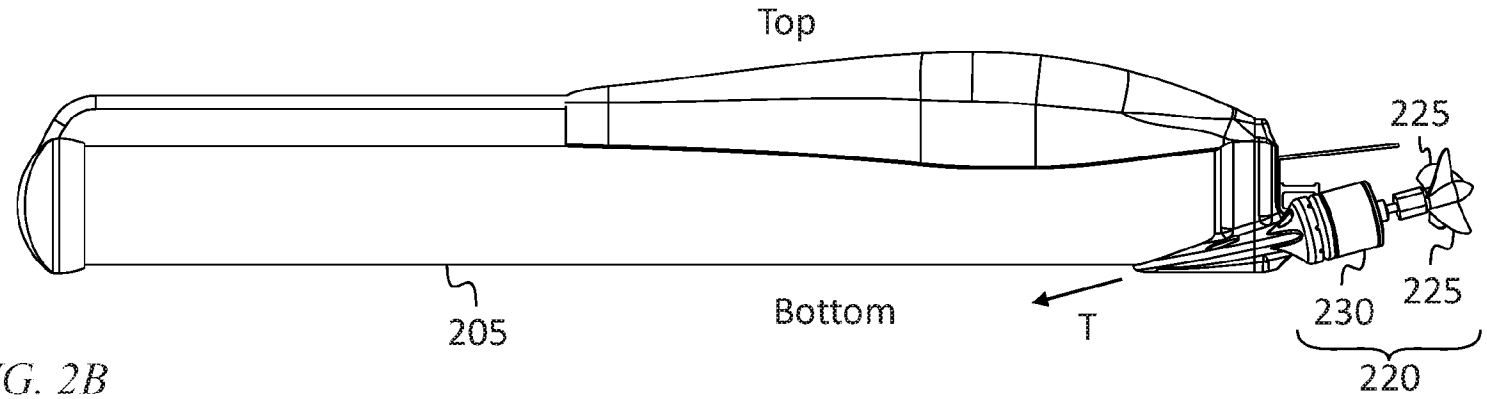
FIG. 2B is a side view of a vehicle, according to an embodiment of the present invention.
Figure 2C:
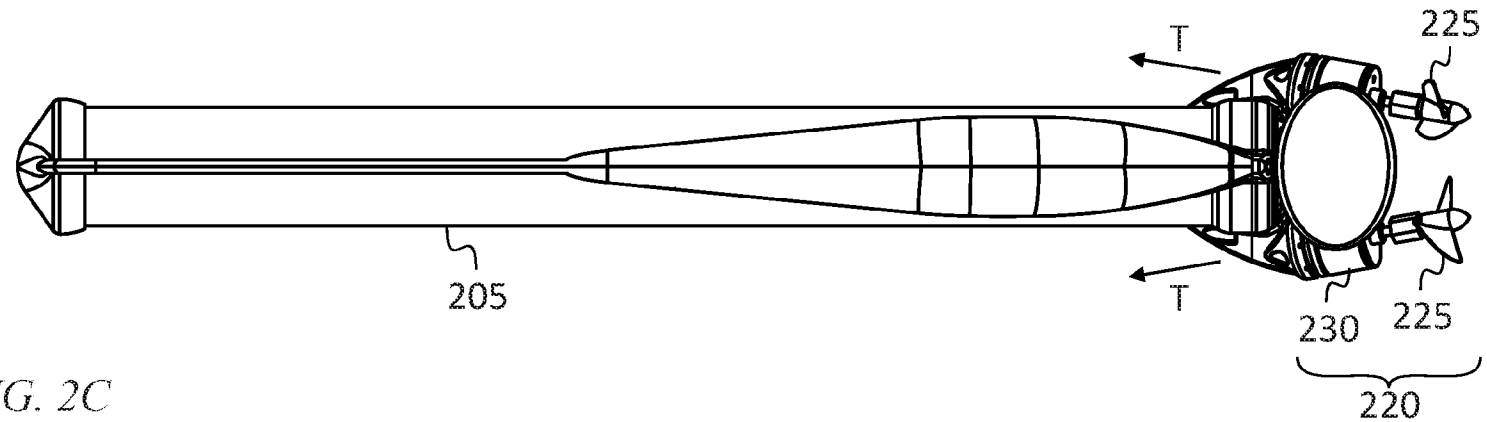
FIG. 2C is a top view of a vehicle, according to an embodiment of the present invention.

Referring to FIG. 2A, in one embodiment, the vehicle includes a hull formed from a slender tube 205 having a front end 210 and a rear end 215, and it is controlled by two actuators 220 each including a propeller 225 and a motor 230, positioned at the rear end 215. In some embodiments, the propellers 225, and the electric motors 230 that turn them, are the only moving parts, and the two actuators are configured to control the orientation of the vehicle in three dimensions (e.g., pitch, yaw, and roll), and also to control the location of the vehicle in three dimensions. The vehicle may include a buoyant fin (or "foam ridge") 235 to enhance the stability of the vehicle. FIGS. 2B and 2C show side and top views of the vehicle, respectively. The thrust vector T for each of the actuators 220 (for forward thrust) is shown, and can be seen to be inclined (in FIG. 2A) and toed out (in FIG. 2B). In some embodiments the amount of toe-out is 10 degrees and the amount of incline is 20 degrees.

Figure 3A:
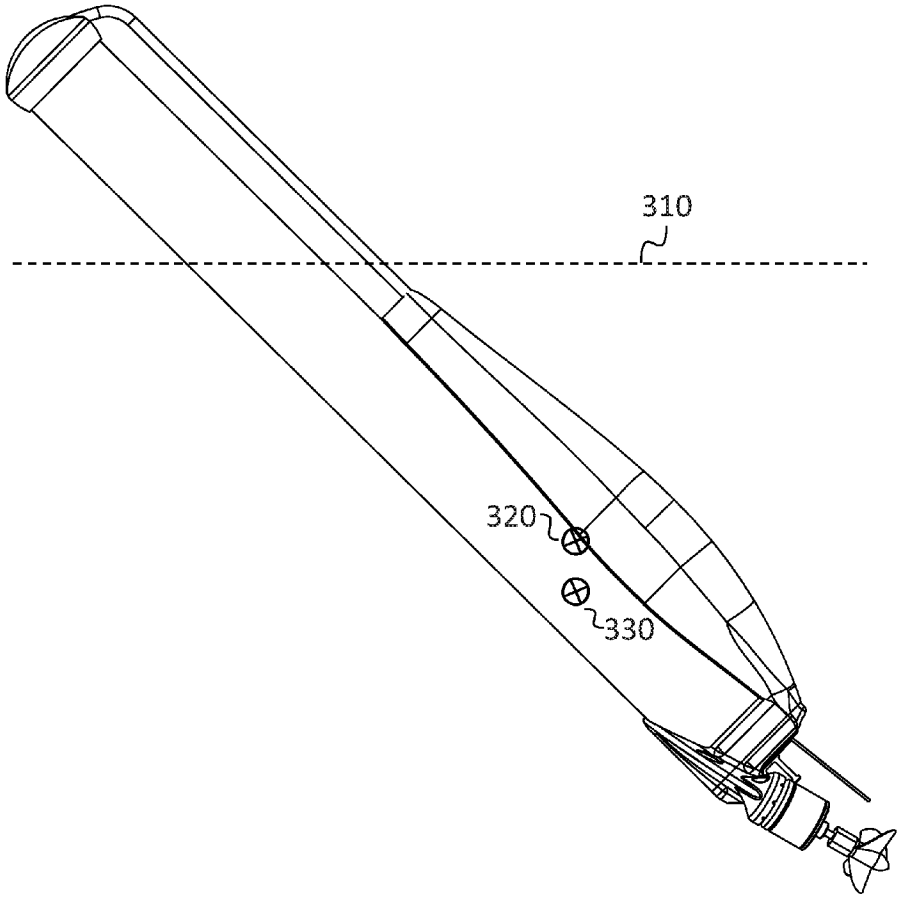
FIG. 3A is a side view of a vehicle in a first steady-state position, according to an embodiment of the present invention.
Figure 3B:
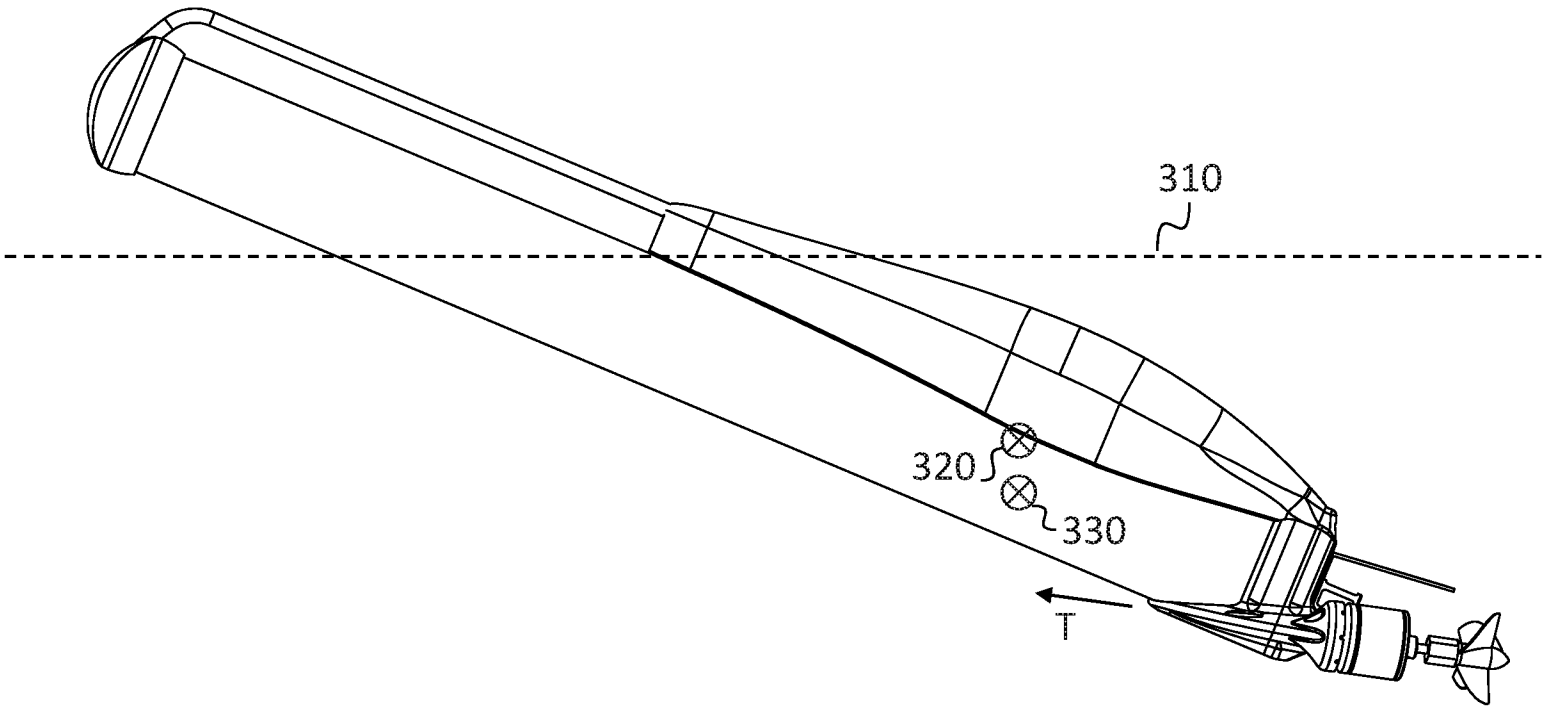
FIG. 3B is a side view of a vehicle in a second steady-state position, according to an embodiment of the present invention.
Figure 3C:
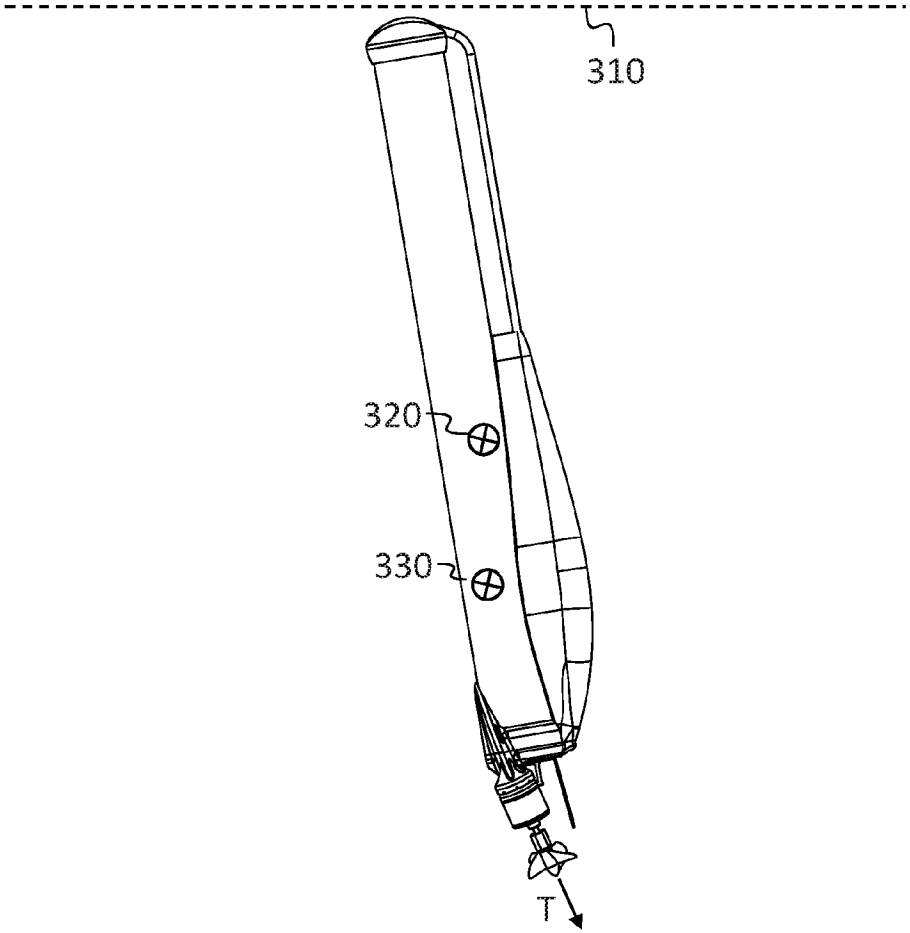
FIG. 3C is a side view of a vehicle in a third steady-state position, according to an embodiment of the present invention.

FIGS. 3A-3C shows three stable positions (i.e., orientations) of the vehicle, for (FIG. 3A) no thrust, (FIG. 3B) full forward thrust, and (FIG. 3C) full reverse thrust. The behavior of the vehicle under the effect of thrust is influenced by the locations of the center of mass 330 and the center of buoyancy 320. The center of mass 330 (the location of which may depend primarily on the location of batteries within the hull) may be closer to the bottom of the hull than to the top of the hull, and the center of buoyancy may be closer to the hull's centerline. A mean water surface level 310, is shown as a dashed line. As used herein, characteristics of the vehicle with respect to the mean surface level of the body of water refer to the characteristics the vehicle has in calm water, with negligible height variations due to waves.

When no thrust is provided by the actuators, the orientation of the vehicle assumes a position (the neutral position, FIG. 3A) in which the center of buoyancy 320 (i.e., the centroid of submerged volume) is directly above the center of mass. In the neutral position, the elevation angle (or "angle of incline") of the longitudinal axis of the vehicle (defined herein to be the centerline of the tube 205) may be between 20 and 70 degrees, or, in another embodiment, greater than 20 degrees and as great as 90 degrees.

When the actuators 220 are activated to produce forward thrust in a mode referred to as drive mode, the vehicle may transition to the drive position illustrated in FIG. 3B. When the actuators produce forward thrust, the thrust vector may have a vertical component, and, once in forward motion, lift forces on the hull of the vehicle may also have a vertical component, both tending to raise the vehicle out of the water. As a result, the center of buoyancy may shift rearward, resulting in a steady-state position (i.e., orientation) that is more parallel to the surface of the water. In both the neutral and drive positions, the nose of the vehicle may be out of the water, making radio or microwave communications through antennas in the nose of the vehicle possible. In the drive position the elevation angle of the longitudinal axis of the vehicle may be between 0 and 40 degrees.

When reverse or rearward thrust is applied, the vehicle may transition to the dive position illustrated in FIG. 3C. This may occur as a result of the reverse thrust having a vertical component that pulls the vehicle farther into the water, which in turn causes the center of buoyancy to shift forward. The forward shift of the center of buoyancy causes the vehicle to rotate (e.g., to pitch up), reaching a steady state orientation in the dive position that is nearly vertical, with, e.g., the elevation angle of the longitudinal axis being greater than 60 degrees.

Angles of incline in the various positions may be referenced to a horizontal plane perpendicular to the gravity vector, i.e., parallel with the surface of the body of water in the absence of waves. The elevation angle of the longitudinal axis may be greater in the neutral position than in the drive position, and greater in the dive position than in the neutral position.

In some embodiments, a pair of motors turning counter-rotating propellers, arranged side-by-side at the rear of the vehicle makes it possible to utilize variable thrust and/or torque to turn and twist the vehicle while it is being driven horizontally or diving vertically.

Figure 4A:
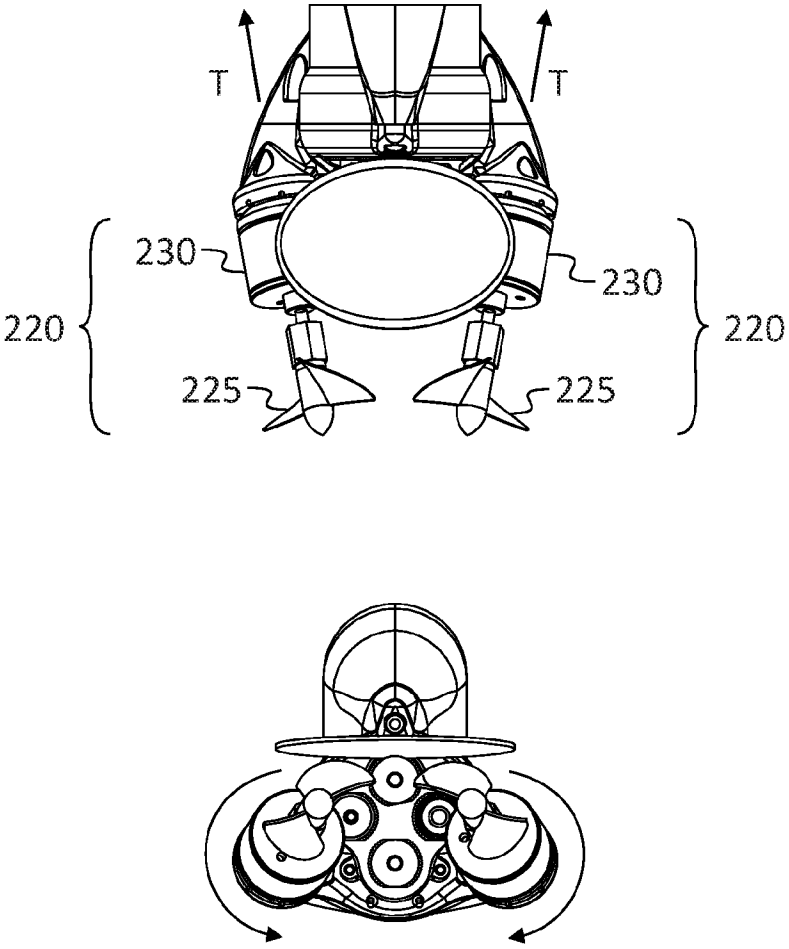
FIG. 4A is a top view and a rear view of the rear end of a vehicle, illustrating a thrust configuration, according to an embodiment of the present invention.
Figure 4B:
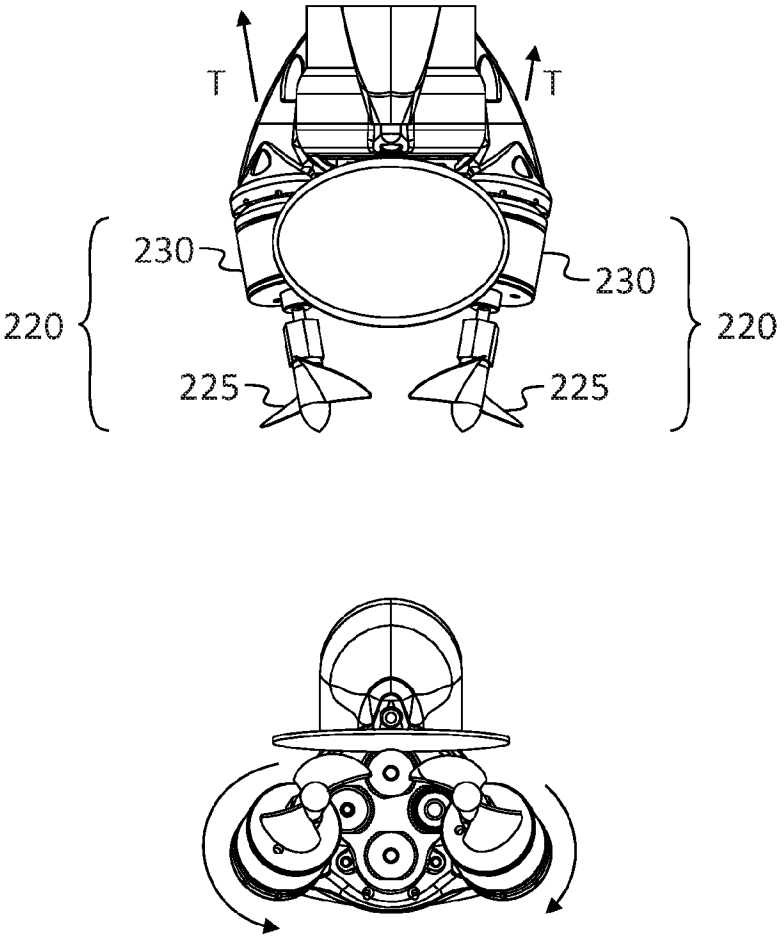
FIG. 4B is a top view and a rear view of the rear end of a vehicle, illustrating a thrust configuration, according to an embodiment of the present invention.
Figure 4C:
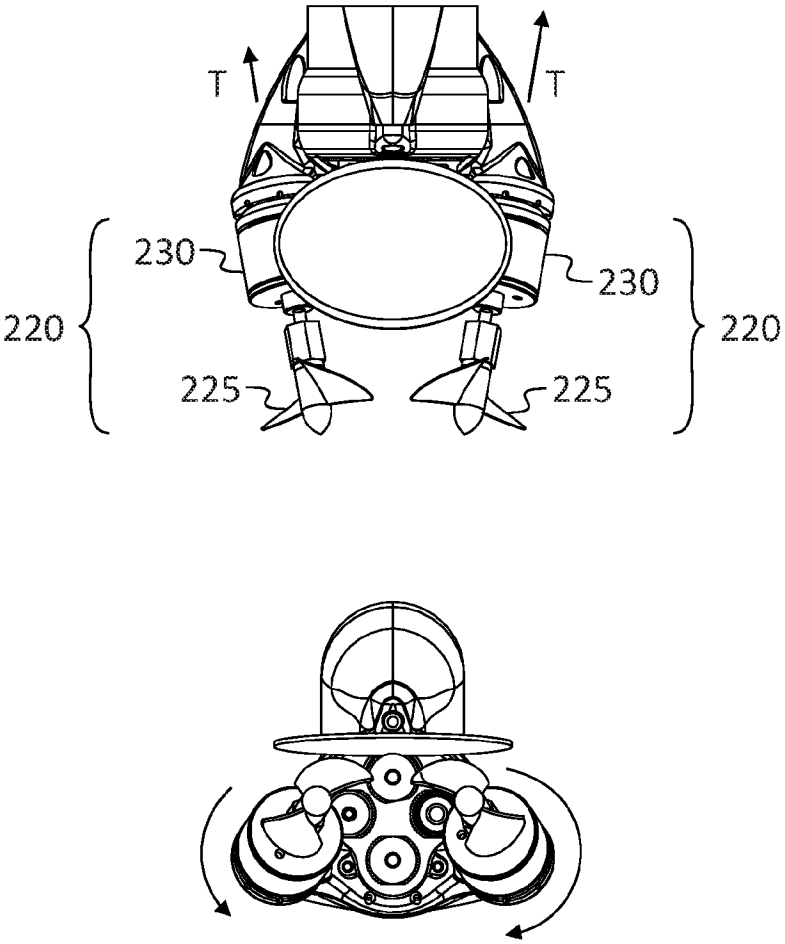
FIG. 4C is a top view and a rear view of the rear end of a vehicle, illustrating a thrust configuration, according to an embodiment of the present invention.

Referring to FIGS. 4A, 4B, and 4C, in drive mode the vehicle may use differential thrust control to steer while driving forward. The direction of propeller rotation (top outward) and the spacing and toe-out of the propellers may produce smoothly coordinated turns (e.g., the vehicle may roll slightly left when turning (yawing) left, and it may roll slightly right when turning right), by varying the rotation speeds of the two propellers. FIG. 4A shows a configuration in which the vehicle is driving substantially in a straight line, with both propellers turning at substantially the same speed. FIG. 4B shows a thrust configuration for making a right turn, with the propeller 225 of the left actuator 220 turning faster than the propeller 225 of the right actuator 220, and, accordingly, the left actuator 220 producing more thrust than the right actuator 220. FIG. 4C shows a thrust configuration for making a left turn, with the propeller 225 of the right actuator 220 turning faster than the propeller 225 of the left actuator 220.

Figure 5A:
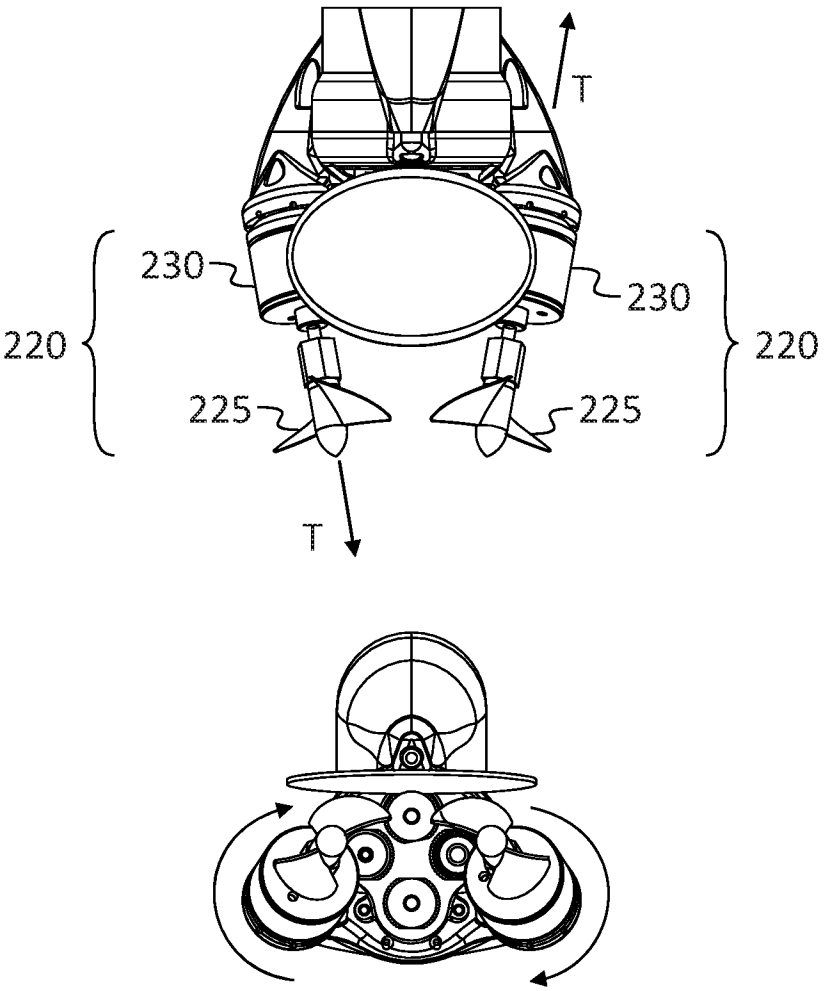
FIG. 5A is a top view and a rear view of the rear end of a vehicle, illustrating a thrust configuration, according to an embodiment of the present invention.
Figure 5B:
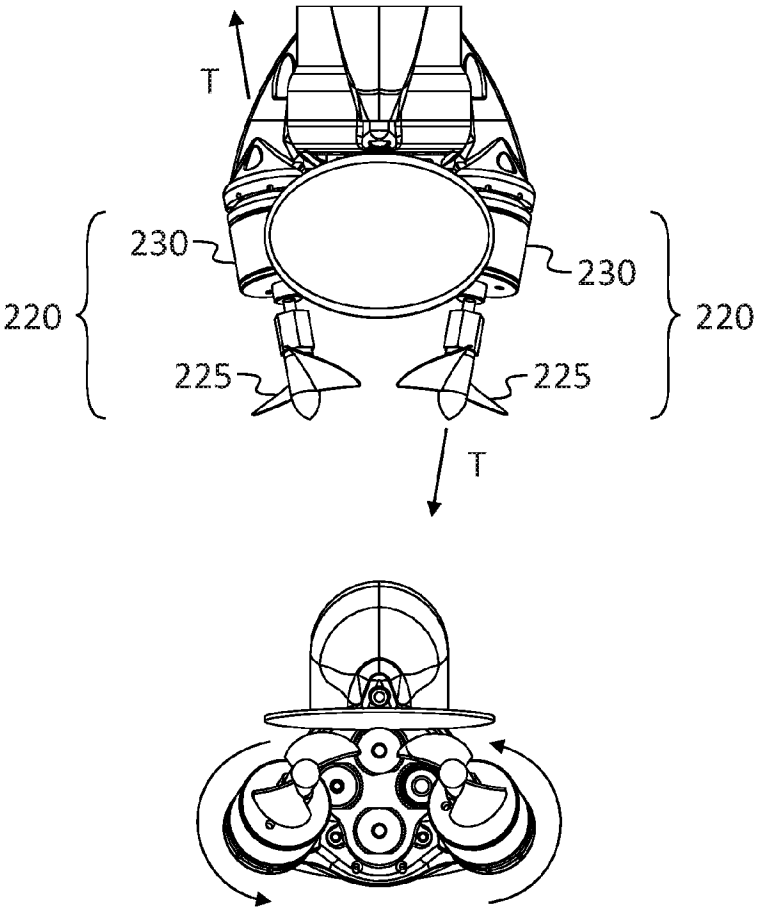
FIG. 5B is a top view and a rear view of the rear end of a vehicle, illustrating a thrust configuration, according to an embodiment of the present invention.

FIGS. 5A and 5B illustrate a control-in-place mode, in which the two actuators 220 produce substantially equal and (except for the misalignment due to toe in) opposite thrust, to rotate the vehicle in yaw without moving significantly through the water. In the thrust configuration of FIG. 5A, the right actuator 220 produces forward thrust and the left actuator 220 produces reverse thrust, so that the vehicle rotates, in yaw, to the left. In the thrust configuration of FIG. 5B, the left actuator 220 produces forward thrust and the right actuator 220 produces reverse thrust, so that the vehicle rotates, in yaw, to the right. To enable the vehicle to perform in place maneuvers of this kind, the hull shape and center of mass may be selected to provide sufficient roll stability (e.g., by the inclusion of the buoyant fin 235), to avoid exhibiting unacceptable amounts of roll when both propellers 225 rotate in the same direction.

Figure 6A:
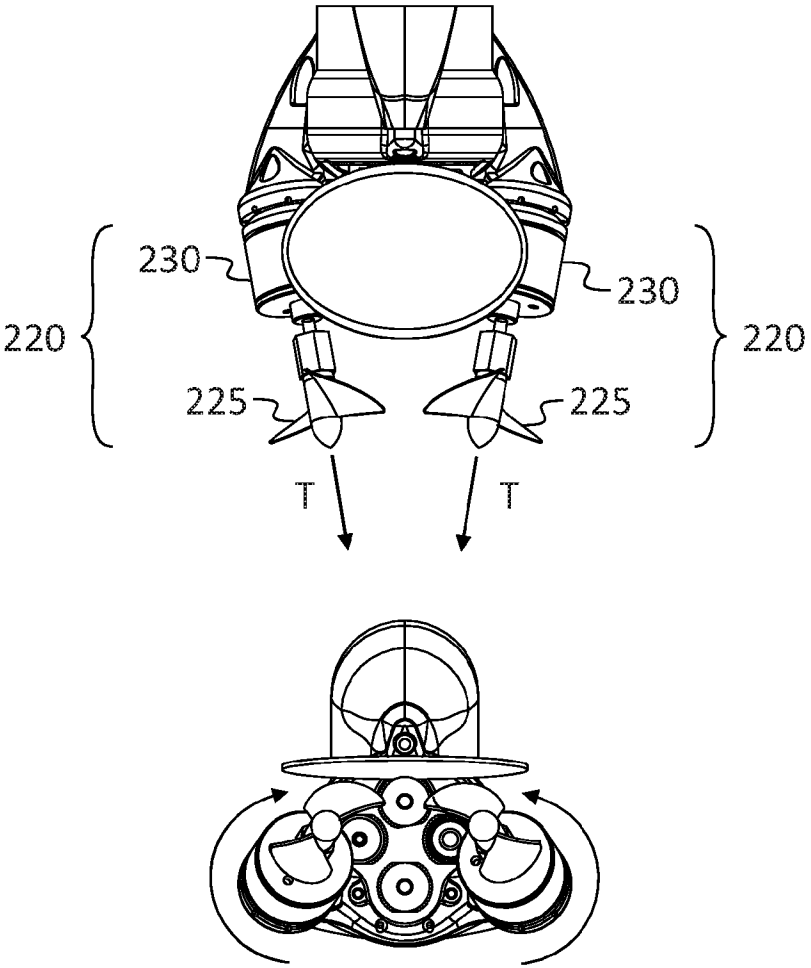
FIG. 6A is a top view and a rear view of the rear end of a vehicle, illustrating a thrust configuration, according to an embodiment of the present invention.
Figure 6B:
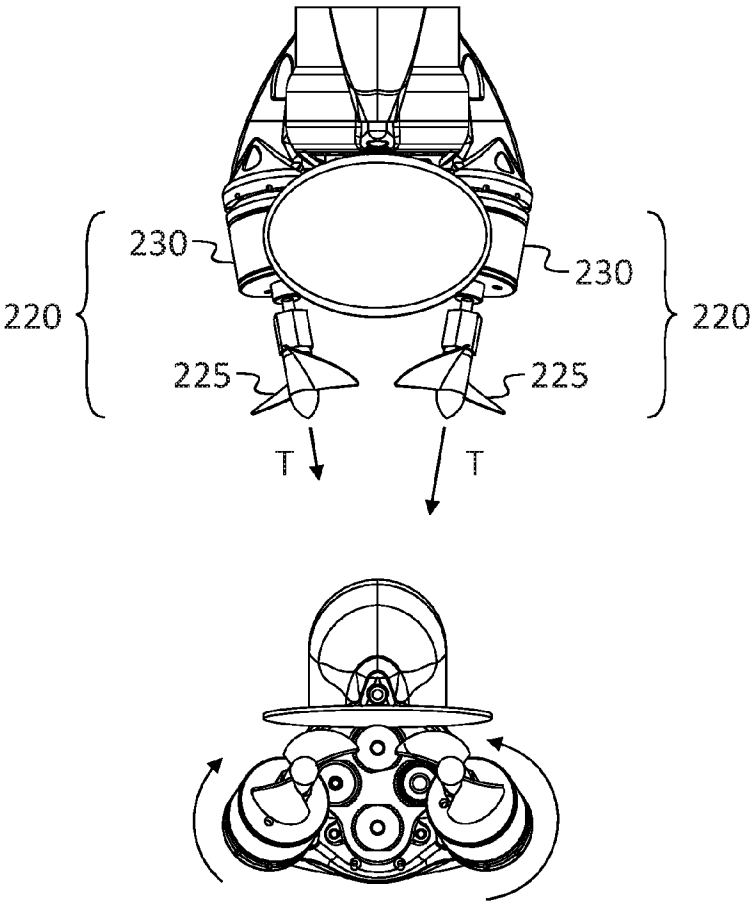
FIG. 6B is a top view and a rear view of the rear end of a vehicle, illustrating a thrust configuration, according to an embodiment of the present invention.
Figure 6C:
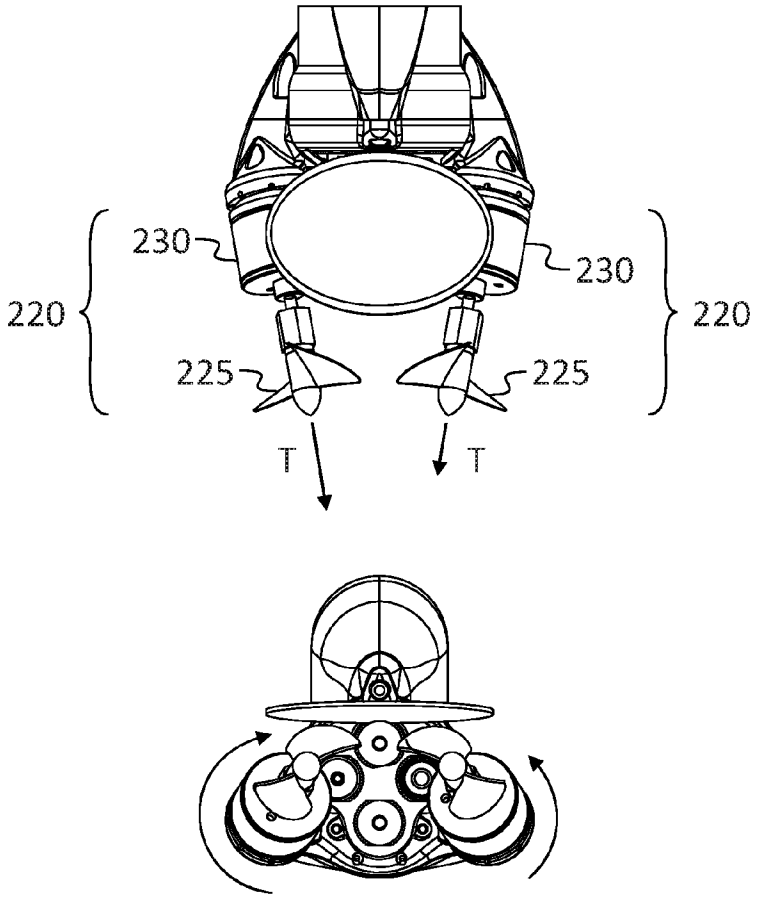
FIG. 6C is a top view and a rear view of the rear end of a vehicle, illustrating a thrust configuration, according to an embodiment of the present invention.

Referring to FIGS. 6A, 6B, and 6C, in dive mode the vehicle may use differential rotation of the propellers 225 to control roll (or "twist" about the longitudinal axis), while the vehicle is substantially vertical. FIG. 6A shows a configuration in which the vehicle is diving substantially in a straight vertical line, with both propellers turning at substantially the same speed. FIG. 6B shows a thrust configuration in which the right propeller 225 turns faster than the left propeller 225, and the vehicle may roll clockwise, i.e., it may twist in a direction that is counterclockwise when viewed from above. FIG. 6C shows a thrust configuration in which the left propeller 225 turns faster than the right propeller 225, and the vehicle may roll counterclockwise, i.e., it may twist in a direction that is clockwise when viewed from above. In this manner the roll orientation of the vehicle may be controlled during a dive.

In some embodiments, the vehicle is capable of exhibiting various useful behaviors. The vehicle may be driven, i.e., controlled directly, in real time by an operator, for example, or if the vehicle is equipped with a compass, a Global Positioning System (GPS) receiver, and a simple autopilot, the vehicle may drive semi-autonomously.

Some semi-automated behaviors may be useful when the vehicle is used as a near-shore access vehicle. For example, when navigating through the surf zone, the vehicle may get tumbled and dragged a small distance toward shore with each passing wave (because it has a small amount of buoyancy). In the intervals between waves, the operator may wish to keep the vehicle pointed into the approaching waves, but the vehicle may be repeatedly engulfed by breaking waves resulting in frequent loss of visual and radio contact. To enable the vehicle to better traverse the surf zone, the vehicle may include an autopilot that incorporates orientation data from an onboard compass to keep the vehicle automatically reorienting to a desired heading. The autopilot may be configured so that if the vehicle is within 90 degrees of the desired heading it will continue at its present thrust magnitude and attempt to turn in the desired direction. If the vehicle heading differs by more than 90 degrees from the commanded heading, the autopilot may apply moderate reverse thrust to help submerge the vehicle so a breaking wave may pass over the vehicle more easily.

Automated control may also be useful for diving, during which radio contact may be lost. In one embodiment, when the vehicle is commanded to dive, it immediately sets both actuators 220 to provide full reverse thrust, initiating a descent. Once the vehicle is below a depth of one meter, the actuator thrust may follow a pre-assigned regulation routine to dive at a constant rate or pause at a series of depths for a specified amount of time. In some situations, for example if the vehicle is carrying a camera, information from the onboard compass may be used to hold a consistent orientation during a dive. Upon reaching a target depth, or if for some reason the expected downward progress has stopped for more than five seconds (e.g. the vehicle has hit the seafloor), the motors 230 may stop and the vehicle may passively float vertically back to the surface and return to the neutral position. Once at the surface, the vehicle may go into a special communication mode to transfer data gathered during the dive.

In some situations it may be useful for the vehicle to "leap", i.e., to propel itself entirely or largely above the surface of the water. For example, an operator may lose sight of the vehicle in a larger body of water, such as the ocean. A leap may be performed by first running the motors 230 in full reverse until the rear end of the vehicle is approximately (or about) one meter deep. By the time the vehicle has descended to this depth, it may also have become rotated into a vertical orientation, as described above. If the actuators 220 are then operated at full forward thrust for about one second, the vehicle may be propelled straight up, potentially entirely into the air. This sequence may be commanded once, or it may be set to repeat every few seconds. The increased activity and elevation both make it easier to see the vehicle, and radio communication range may be temporarily increased while the front of the vehicle is higher above the surface of the water than it is normally.

Figure 7:
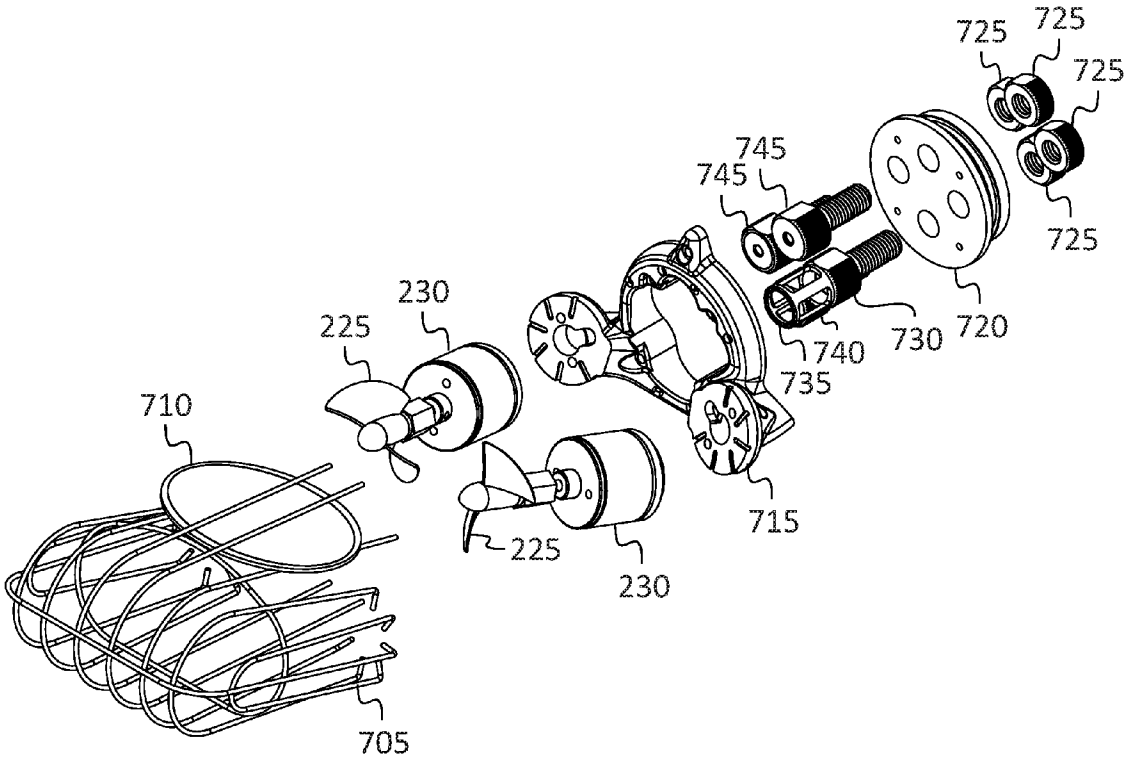
FIG. 7 is an exploded view of the rear end of a vehicle, according to an embodiment of the present invention.

FIG. 7 is an exploded view of the rear end of the vehicle. A motor cage 705 (omitted from FIGS. 1-6C for clarity), that may be formed of stainless wire bent into shape and welded where the wires touch, encloses the two actuators. A depressor plate 710, formed, e.g., of acrylonitrile butadiene styrene (ABS), acts as a fin providing pitch stability when the vehicle is in motion. The propellers may be 42.5 mm diameter propellers, the left propeller having a left-handed pitch, and the right propeller having a right-handed pitch. Each of the motors 230 may be a model M100 sealed brushless DC motor available from Blue Robotics™ (www-.bluerobotics.com). The motors 230 are mounted on a motor mount 715 formed of cast urethane, which is secured to a rear end cap 720. Four bolts 730, 740, 745 are secured in through holes in the rear end cap 720 with nuts 725. A temperature sensor bolt 730 includes a sealed temperature sensor in a protective cage 735, connected to circuitry inside the tube 205 by wires passing through an axial hole in the bolt. A pressure sensor bolt 740 (partially obscured in FIG. 7 by the temperature sensor bolt 730) similarly provides a pressure signal to circuitry inside the tube 205 by wires passing through an axial hole in the bolt. Two motor pass-through bolts 745 provide a seal for motor wires from drive circuitry (electronic speed controllers), in the tube 205, that provide power to the motors 230. Each of the four bolts 730, 740, 745 has an O-ring in a groove on the underside of the head of the bolt, for sealing against the rear end cap 720. The rear end cap 720 is sealed against the tube 205 with an O-ring.

Figure 8:
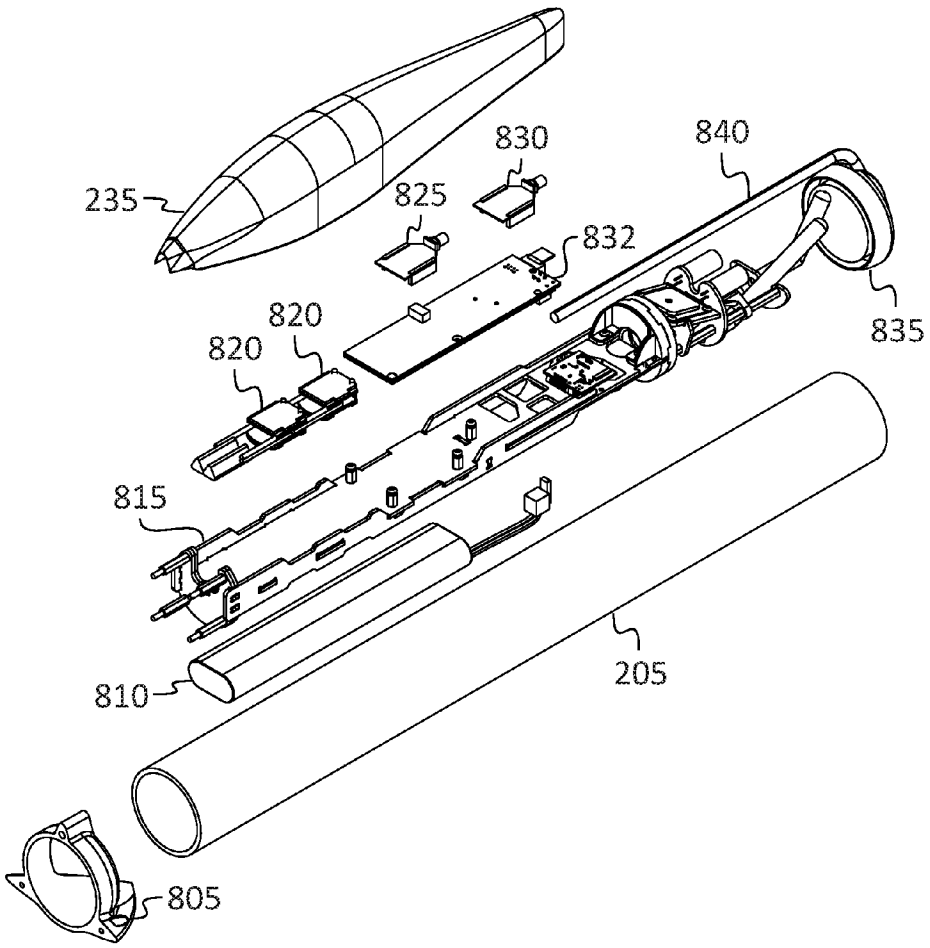
FIG. 8 is an exploded view of the middle portion and front end of a vehicle, according to an embodiment of the present invention.

FIG. 8 is an exploded view of the middle portion and front end of the vehicle. A tail anchor 805, formed, e.g., of TASK 9™ urethane casting resin available from Smooth-On™ (www.smooth-on.com) is molded onto the tube 205 so as to be securely adhered to the tube 205, and provides features for securing the motor mount 715, e.g., with threaded fasteners. A 76 Watt-hour 3-cell lithium polymer battery 810 provides power for the system, and an internal frame 815, composed, e.g., of FR-4 (flame retardant 4, a fiberglass reinforced plastic material), supports the components in the tube 205. Each of two electronic speed controllers (ESCs) 820 provides power to and controls a respective one of the motors 230. A 900 MHz radio 825 provides a command and telemetry connection to an operator console, and a 2.4 GHz radio 830 provides the capability to communicate with other similar vehicles. A nose 835 and handle 840 may be composed of FEATHER LITE™ filled low-density urethane casting resin, and may seal the front end of the tube 205, and facilitate carrying of the vehicle by an operator, respectively. The nose 835 may be molded onto the tube 205 so as to be securely adhered to the tube 205, and the handle 840 may be one integral part with the nose 835. The buoyant fin 235 may be composed of FOAM-IT!™ 10 SLOW castable rigid expanding urethane foam available from Smooth-On.

A main control board 832 includes a microprocessor or microcontroller for performing all high-level command, telemetry, sequencing, and control functions. The main control board 832 also includes interface circuitry for connecting to external circuitry such as the temperature sensor bolt 730, the pressure sensor bolt 740, the ESCs 820, the radios 825, 830, and a GPS receiver 915 and inertial measurement unit 920 (FIG. 9).

Figure 9:
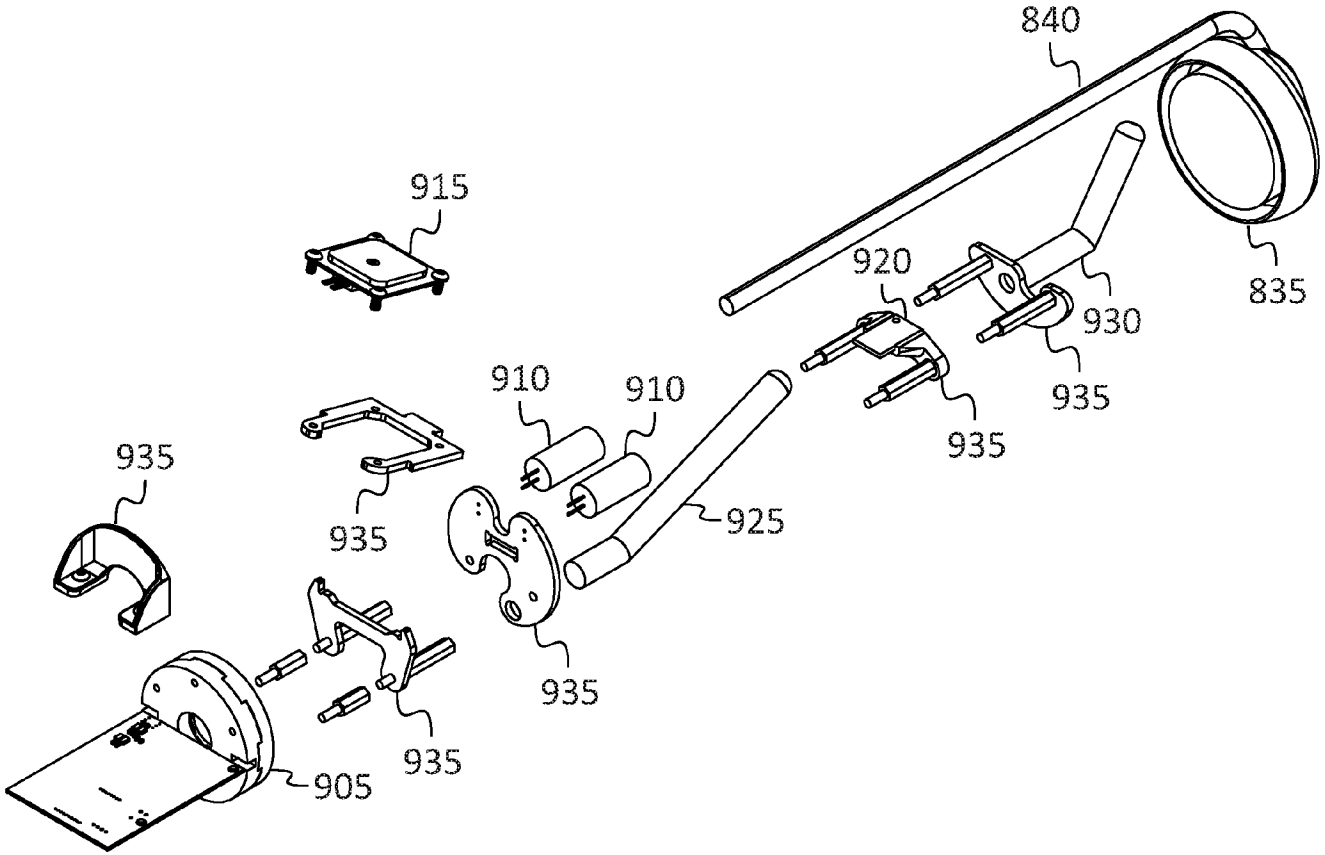
FIG. 9 is an exploded view of the front end of a vehicle, according to an embodiment of the present invention.
Figure 10B:
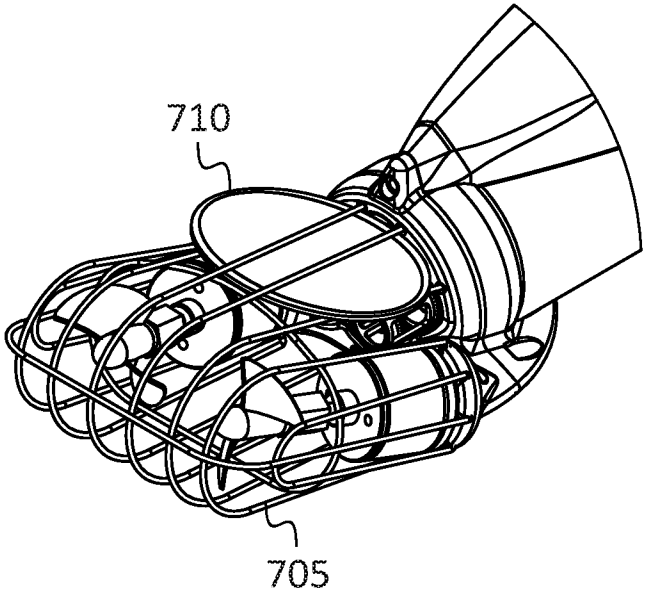
FIG. 10B is a view of the portion of the vehicle shown in FIG. 10A, with a motor cage installed, according to an embodiment of the present invention.
Figure 10A:
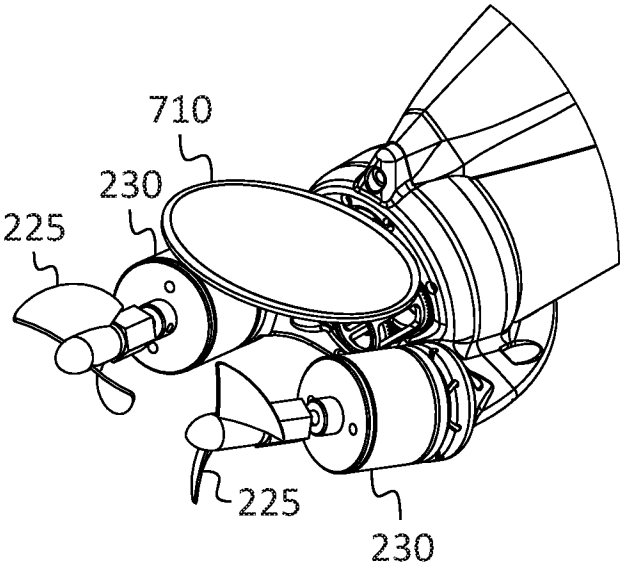
FIG. 10A is an enlarged view of region 10A of FIG. 2A, according to an embodiment of the present invention.

FIG. 9 is an exploded view of the front end of the vehicle. A wireless charging system 905 makes it possible to recharge the vehicle battery by inductive coupling to an external coil in a charging station. Light-emitting diodes (LEDs) 910 may be used to visually signal vehicle position and status to an operator. A Global Positioning System (GPS) receiver 915 and an inertial measurement unit (IMU) 920 may be employed for navigation. A 900 MHz antenna 925 and a 2.4 GHz antenna 930 provide coupling to free space for the corresponding radios 825, 830. Miscellaneous brackets 935 and standoffs 940 secure the components together and support them within the tube 205. FIGS. 10A and 10B are enlarged views of the rear end 215 of the vehicle, without (FIG. 10A) and with (FIG. 10B) the motor cage 705.

In light of the foregoing, a simple, maneuverable vehicle capable of navigating on the surface of water, and of diving below the surface, may be constructed as described herein, with two actuators each capable of providing adjustable forward or reverse thrust. In some embodiments a single actuator may provide a similar ability to operate in three stable positions. Such an embodiment may however provide less effective control over the six degrees of freedom of the vehicle (three in orientation, and three in location). Similarly, in some embodiments (as illustrated in some of the drawings, e.g., in FIG. 2A and in FIG. 7), both propellers 225 may have a left-handed pitch, or both propellers may have a right-handed pitch.

In some embodiments the main control board 832 includes a processing circuit, e.g., a microcontroller on the main control board 832 may include a processing circuit. The term "processing circuit" is used herein to include any combination of hardware, firmware, and software, employed to process data or digital signals. Processing circuit hardware may include, for example, application specific integrated circuits (ASICs), general purpose or special purpose central processing units (CPUs), digital signal processors (DSPs), graphics processing units (GPUs), and programmable logic devices such as field programmable gate arrays (FPGAs). In a processing circuit, as used herein, each function is performed either by hardware configured, i.e., hard-wired, to perform that function, or by more general purpose hardware, such as a CPU, configured to execute instructions stored in a non-transitory storage medium. A processing circuit may be fabricated on a single printed wiring board (PWB) or distributed over several interconnected PWBs. A processing circuit may contain other processing circuits; for example a processing circuit may include two processing circuits, an FPGA and a CPU, interconnected on a PWB.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art. As used herein, the term "major component" means a component constituting at least half, by weight, of a composition, and the term "major portion", when applied to a plurality of items, means at least half of the items.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present invention". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

Although exemplary embodiments of a water drone have been specifically described and illustrated herein, many modifications and variations will be apparent to those skilled in the art. Accordingly, it is to be understood that a water drone constructed according to principles of this invention may be embodied other than as specifically described herein. The invention is also defined in the following claims, and equivalents thereof.

What is claimed is:

1. A vehicle for use in a body of water having a surface, the vehicle comprising:

a hull having a front end and a rear end and defining a longitudinal axis;

a communications system comprising an antenna positioned at the front end of the hull; and a propulsion system comprising two actuators, each actuator comprising a propeller positioned at the rear end of the hull and configured to supply thrust along a thrust vector, the hull and the actuators of the vehicle being configured such that the vehicle:

assumes a first steady-state orientation when the propulsion system produces no thrust, an elevation angle of the longitudinal axis in the first steady-state orientation being greater than 20 degrees, wherein the antenna is kept above the surface of the body of water;

assumes a second steady-state orientation when the propulsion system produces forward thrust of a first magnitude, the elevation angle of the longitudinal axis in the second steady-state orientation being greater than 0 degrees and less than 40 degrees, wherein the antenna is kept above the surface of the body of water; and assumes a third steady-state orientation when the propulsion system produces reverse thrust of a second magnitude, the elevation angle of the longitudinal axis in the third steady-state orientation being greater than 60 degrees, wherein a center of mass of the vehicle is identically located while the vehicle is in each of the first steady-state orientation, the second steady-state orientation, and the third steady-state orientation.

2. The vehicle of claim 1, wherein the elevation angle of the longitudinal axis in the first steady-state orientation is greater than the elevation angle of the longitudinal axis in the second steady-state orientation.

3. The vehicle of claim 2, wherein the elevation angle of the longitudinal axis in the first steady-state orientation is greater than the elevation angle of the longitudinal axis in the second steady-state orientation by at least 10 degrees.

4. The vehicle of claim 1, wherein the elevation angle of the longitudinal axis in the third steady-state orientation is greater than the elevation angle of the longitudinal axis in the first steady-state orientation.

5. The vehicle of claim 4, wherein the elevation angle of the longitudinal axis in the third steady-state orientation is greater than the elevation angle of the longitudinal axis in the first steady-state orientation by at least 10 degrees.

6. A vehicle for use in a body of water having a surface, the vehicle comprising:

a hull having a front end and a rear end and defining a longitudinal axis;

a communications system comprising an antenna positioned at the front end of the hull; and a propulsion system comprising two actuators, each actuator comprising a propeller positioned at the rear end of the hull and configured to supply thrust along a thrust vector, the hull and the actuators of the vehicle being configured such that the vehicle:

assumes a first steady-state orientation when the propulsion system produces no thrust, an elevation angle of the longitudinal axis in the first steady-state orientation being greater than 20 degrees;

assumes a second steady-state orientation when the propulsion system produces forward thrust of a first magnitude, the elevation angle of the longitudinal axis in the second steady-state orientation being greater than 0 degrees and less than 40 degrees; and assumes a third steady-state orientation when the propulsion system produces reverse thrust of a second magnitude, the elevation angle of the longitudinal axis in the third steady-state orientation being greater than 60 degrees, wherein a center of mass of the vehicle is identically located while the vehicle is in each of the first steady-state orientation, the second steady-state orientation, and the third steady-state orientation, wherein in the first steady-state orientation and in the second steady-state orientation the front end of the hull is entirely above the surface of the body of water.

7. The vehicle of claim 1, wherein the two actuators are configured to be independently controllable.

8. The vehicle of claim 1, wherein the propulsion system of the vehicle is capable of producing sufficient reverse thrust to overcome a buoyancy of the vehicle and displace the vehicle entirely below the surface of the body of water.

9. A vehicle for use in a body of water having a surface, the vehicle comprising:

a hull having a front end and a rear end and defining a longitudinal axis;

a communications system comprising an antenna positioned at the front end of the hull; and a propulsion system positioned at the rear end of the hull and configured to supply thrust along a thrust vector, the hull and the propulsion system of the vehicle being configured such that the vehicle:

assumes a first steady-state orientation when the propulsion system produces no thrust, an elevation angle of the longitudinal axis in the first steady-state orientation being greater than 20 degrees, wherein the antenna is kept above the surface of the body of water;

assumes a second steady-state orientation when the propulsion system produces forward thrust of a first magnitude, the elevation angle of the longitudinal axis in the second steady-state orientation being greater than 0 degrees and less than 40 degrees, wherein the antenna is kept above the surface of the body of water; and assumes a third steady-state orientation when the propulsion system produces reverse thrust of a second magnitude, the elevation angle of the longitudinal axis in the third steady-state orientation being greater than 60 degrees, wherein a center of mass of the vehicle is identically located while the vehicle is in each of the first steady-state orientation, the second steady-state orientation, and the third steady-state orientation.

10. The vehicle of claim 8, wherein the two actuators are configured to be independently controllable and the vehicle is capable of steady-state rotation in roll at a substantially constant rate of roll when:

the vehicle is entirely below the surface of the body of water; and a first actuator of the two actuators produces reverse thrust of a first magnitude and a second actuator of the two actuators produces reverse thrust of a second magnitude, the first magnitude being greater than the second magnitude.

11. The vehicle of claim 10, wherein the rate of roll is greater than 20 degrees per second.

12. The vehicle of claim 7, wherein the vehicle is capable of steady-state rotation in yaw at a substantially constant rate of yaw when a first actuator of the two actuators produces a first thrust and a second actuator of the two actuators produces a second thrust, the first thrust being different from the second thrust.

13. The vehicle of claim 12, wherein the first thrust is a forward thrust and the second thrust is a reverse thrust.

14. The vehicle of claim 12, wherein the first thrust is a forward thrust of a first magnitude and the second thrust is a forward thrust of a second magnitude, the first magnitude being greater than the second magnitude.

15. The vehicle of claim 12, wherein the rate of yaw is greater than 5 degrees per second.

16. The vehicle of claim 1, wherein a center of volume of the vehicle is identically located while the vehicle is in each of the first steady-state orientation, the second steady-state orientation, and the third steady-state orientation.

17. A vehicle for use in a body of water having a surface, the vehicle comprising:

a hull having a front end and a rear end and defining a longitudinal axis;

a communications system comprising an antenna positioned at the front end of the hull; and a propulsion system comprising two actuators, each actuator comprising a propeller positioned at the rear end of the hull and configured to supply thrust along a thrust vector, the hull and the actuators of the vehicle being configured such that the vehicle:

assumes a first steady-state orientation when the propulsion system produces no thrust, an elevation angle of the longitudinal axis in the first steady-state orientation being greater than 20 degrees;

assumes a second steady-state orientation when the propulsion system produces forward thrust of a first magnitude, the elevation angle of the longitudinal axis in the second steady-state orientation being greater than 0 degrees and less than 40 degrees; and assumes a third steady-state orientation when the propulsion system produces reverse thrust of a second magnitude, the elevation angle of the longitudinal axis in the third steady-state orientation being greater than 60 degrees, wherein a center of volume of the vehicle is closer to the rear end of the hull than to the front end.

18. The vehicle of claim 1, wherein a portion of the antenna is within a front-most one-tenth of the hull.

19. The vehicle of claim 8, wherein the propulsion system of the vehicle is capable of producing sufficient forward thrust to propel the vehicle entirely into the air from an initial position entirely below the surface of the body of water.

20. The vehicle of claim 6, wherein the two actuators are configured to be independently controllable.

21. The vehicle of claim 6, wherein the propulsion system of the vehicle is capable of producing sufficient reverse thrust to overcome a buoyancy of the vehicle and displace the vehicle entirely below the surface of the body of water.

22. The vehicle of claim 21, wherein the propulsion system of the vehicle is capable of producing sufficient forward thrust to propel the vehicle entirely into the air from an initial position entirely below the surface of the body of water.

23. The vehicle of claim 6, wherein the vehicle is capable of steady-state rotation in roll at a substantially constant rate of roll when:

the vehicle is entirely below the surface of the body of water; and a first actuator of the two actuators produces reverse thrust of a first magnitude and a second actuator of the two actuators produces reverse thrust of a second magnitude, the first magnitude being greater than the second magnitude.

24. The vehicle of claim 9, wherein the propulsion system of the vehicle is capable of producing sufficient reverse thrust to overcome a buoyancy of the vehicle and displace the vehicle entirely below the surface of the body of water.

25. The vehicle of claim 24, wherein the propulsion system of the vehicle is capable of producing sufficient forward thrust to propel the vehicle entirely into the air from an initial position entirely below the surface of the body of water.

26. The vehicle of claim 9, wherein the vehicle is capable of steady-state rotation in roll at a substantially constant rate of roll when the vehicle is entirely below the surface of the body of water.

27. The vehicle of claim 9, wherein:

the elevation angle of the longitudinal axis in the first steady-state orientation is greater than the elevation angle of the longitudinal axis in the second steady-state orientation by at least 10 degrees; and the elevation angle of the longitudinal axis in the third steady-state orientation is greater than the elevation angle of the longitudinal axis in the first steady-state orientation by at least 10 degrees.

* * * * *